United States Patent [19]

Edwards et al.

[11] 4,211,395

[45] Jul. 8, 1980

[54] CONNECTOR TOOL

[75] Inventors: Ernest Edwards, Basingstoke; Michael K. Jukes, Reading, both of England

[73] Assignee: International Telephone and Telegraph Corporation, New York, N.Y.

[21] Appl. No.: 944,709

[22] Filed: Sep. 22, 1978

[30] Foreign Application Priority Data

Nov. 22, 1977 [GB] United Kingdom ..... 48616/77

[51] Int. Cl.[2] ..... H01R 43/00; B25B 9/02

[52] U.S. Cl. ..... 269/254 R; 29/281.1; 29/749; 29/760

[58] Field of Search ..... 29/749, 760, 751, 753, 29/281.1–281.5; 269/254 R

[56] References Cited

U.S. PATENT DOCUMENTS

| | | | |
|---|---|---|---|
| 2,827,689 | 3/1958 | Shoffner et al. | 269/254 R |
| 4,005,518 | 2/1977 | Bakermans | 29/749 X |
| 4,020,540 | 7/1976 | Casciotti | 29/749 |

*Primary Examiner*—Carl E. Hall

*Attorney, Agent, or Firm*—A. Donald Stolzy

[57] ABSTRACT

A spring biased jig or the like for holding an electrical connector and a flat cable in position to terminate the cable.

4 Claims, 4 Drawing Figures

CONNECTOR TOOL

BACKGROUND OF THE INVENTION

This invention relates to a termination tool for an electrical connector intended for use with flexible cable.

PRIOR ART STATEMENT

A conventional flexible cable known as ribbon or flat cable incorporates a flat strip of insulating material within which a number of flat strip-like electrical conductors are embedded. The conductors are covered completely by the insulating material with no bare conductor portion showing. The conductors extend parallel along the length of the cable and each conductor is covered on both sides by a thin layer of the insulating material.

Terminating a flat cable is effected by sharp and pointed electrical connector contact shanks which are pressed into and puncture the insulation and then make electrical contact with respective ones of the flat strip conductors.

SUMMARY OF THE INVENTION

In accordance with the tool of the present invention, there is provided two jaws spring biased toward each other such that a flat cable and an electrical connector or connector part to be terminated can be fitted therebetween.

Thus, the tool can be fitted into a vise, while the connector or connector part and cable to be terminated are fitted between the tool jaws. The vise then can be closed so as to cause cable termination.

BRIEF DESCRIPTION OF THE DRAWINGS

In the accompanying drawings which illustrate exemplary embodiments of the present invention.

DESCRIPTION OF THE PREFERRED EMBODIMENTS

Figure 1:
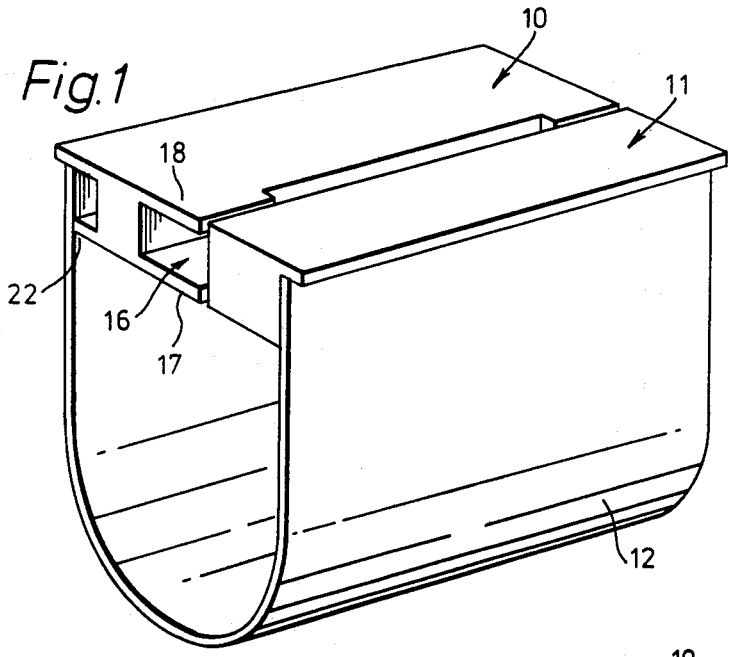
FIG. 1 is a perspective view of one embodiment of the tool of the present invention.
Figure 4:
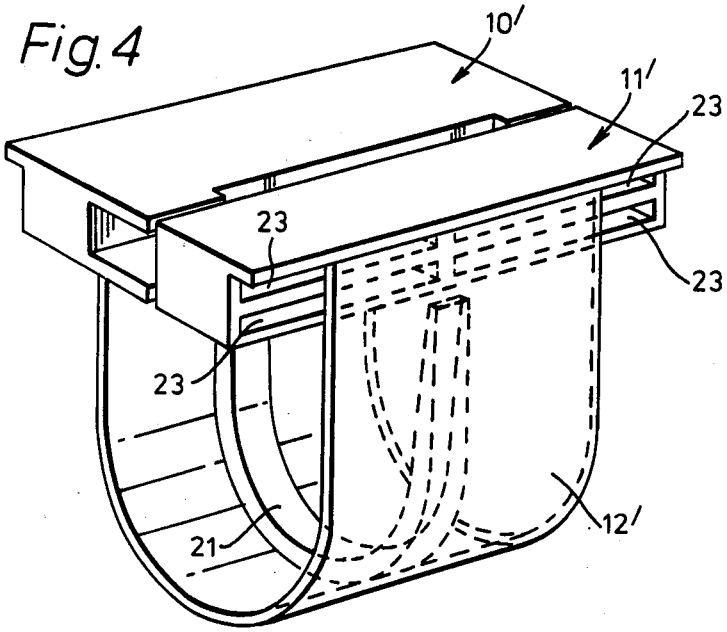
FIG. 4 is a perspective view of an alternative embodiment of the invention.

In the drawings, two jaws 10 and 11 are shown in FIG. 1, each of which is made of a suitable insulating material, for example, polypropathene. These jaws 10 and 11 are interconnected by a U-shaped strip 12 which is also made of an insulating material, again such as polypropathene. The ends of strip 12 may be secured, as by sonic welding, to the two jaws 10 and 11. The strip 12 may be made of a suitable metal if this is preferred. In FIG. 1, if it is made of a plastic material, it may or may not have a stiffening rib 21 moulded integral with or otherwise fixed to the tool, as in FIG. 4. The strip 12 can also have its width the same as the length of the two jaws 10 and 11 or less than that as shown in FIG. 4.

The jaw 11 has a flat face (not shown) while jaw 10 has a recess 16 in its face as shown, into which an adapter such as shown at 15 can be fitted. Its recess 16 is defined by two flat portions 17 and 18 which are parallel to each other, and each of which is notched at 19 and 20, respectively (FIG. 2), to accept a vertical end of a flat cable.

The shape of adapter 15 depends on the configuration of the connector or connector part with which the device is to be used. This adapter 15 is, when in use, fitted into the recess 16 in the jaw 10 being located therein by ribs 13 and 14, each of which fits over a corresponding end face of jaw 10.

When in use, an electrical connector or connector part plus the cable to be terminated are fitted between the jaws 10 and 11, the connector being positioned between adapter 15, if desired, and the cable. With the connector and cable so placed, the same, with the tool of FIG. 1, are placed in a bench vise which is then closed. This urges the jaws 10 and 11 together so that the insulating material of the cable is punctured by a prong or the like on the connector or connector part. In a typical case, the cable is thus terminated to a connector part, whereafter a cover is secured to the part so as to enclose the terminated cable end.

Figure 2:
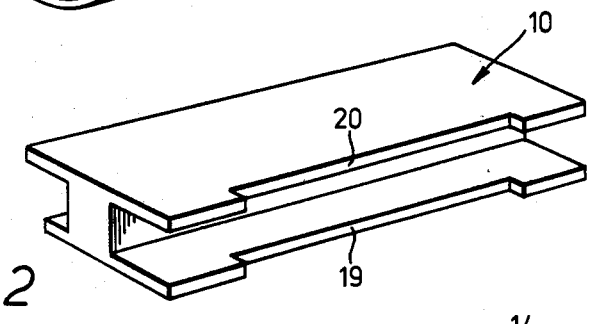
FIG. 2 is a perspective view of one jaw shown in FIG. 1.
Figure 3:
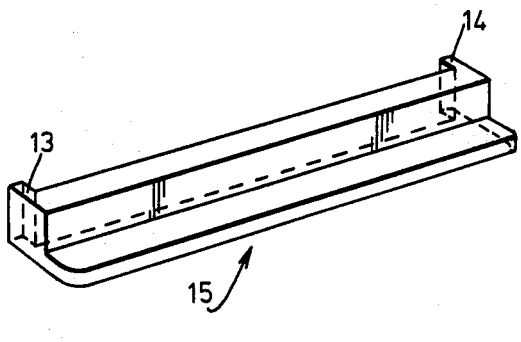
FIG. 3 is a perspective view of a jaw adapter which may be used in connection with the embodiments of the invention shown in FIG. 1 or shown in FIG. 4.

Jaw 10 may have a transverse cross-section uniform along its entire length, if desired, except for notches 19 and 20, as shown in FIG. 2.

Jaws 10' and 11' in FIG. 4 may be identical to or similar to jaws 10 and 11, respectively, as shown in FIG. 1. Jaw 10' may, if desired, be different from jaw 10 only by the omission of flat portion 22 in FIG. 1.

If desired, rectangular slots 23 extend only part way or about halfway through jaw 11', but slots 23 may extend all the way therethrough, if desired.

In FIG. 1 or in FIG. 4, notches similar to notches 19 and 20 (FIG. 2) may be provided in both pairs of jaws or in jaw 11 or 11' only, or as shown.

What is claimed is:

1. A tool for use in terminating a multi-conductor flat cable to a multi-way electrical connector, said tool comprising: two generally parallel jaws mounted adjacent to and parallel with each other, one of said jaws having a recess for receiving said connector therein and at least one of said jaws having a notch for receiving said cable therein; and a U-shaped spring strip having each end secured to one of said jaws, said spring strip for urging said jaws toward each other thereby clamping said connector in said recess and said cable together prior to and during termination of said cable on said connector.

2. A tool as claimed in claim 1, in which one of said jaws is formed by two parallel plate-like portions which extend towards the other jaw, the parallel portions being of the same shape, and in which an adapter is positioned between said plate-like portions.

3. A tool as claimed in claim 2, and in which each of said plate-like portions has a notch, the width of said notches being about equal to the width of said cable.

4. The tool as claimed in claim 1, in which said spring has an internally-located stiffener.

* * * * *

UNITED STATES PATENT OFFICE
CERTIFICATE OF CORRECTION

PATENT NO. : 4,211,395

DATED : July 8, 1980

INVENTOR(S) : E. Edwards-M.K. Jukes 1-1

It is certified that error appears in the above-identified patent and that said Letters Patent are hereby corrected as shown below:

On the Abstract page, (73) Assignee, replace "International Telephone and Telegraph Corporation" with --ITT Industries, Inc.--.

Signed and Sealed this

*Twenty-eighth* Day of *October 1980*

[SEAL]

*Attest:*

SIDNEY A. DIAMOND

*Attesting Officer*

*Commissioner of Patents and Trademarks*